US009726203B2

(12) United States Patent
Knapper

(10) Patent No.: US 9,726,203 B2
(45) Date of Patent: Aug. 8, 2017

(54) HYDRAULIC CONTROL ASSEMBLY

(71) Applicant: Robert Bosch GmbH, Stuttgart (DE)

(72) Inventor: Steffen Knapper, Vaihingen/Enz (DE)

(73) Assignee: Robert Bosch GmbH, Stuttgart (DE)

( * ) Notice: Subject to any disclaimer, the term of this patent is extended or adjusted under 35 U.S.C. 154(b) by 359 days.

(21) Appl. No.: 14/538,122

(22) Filed: Nov. 11, 2014

(65) Prior Publication Data

US 2015/0136251 A1 May 21, 2015

(30) Foreign Application Priority Data

Nov. 15, 2013 (DE) ..... 10 2013 223 288

(51) Int. Cl.
*F15B 11/16* (2006.01)
*F15B 13/06* (2006.01)
*F15B 13/02* (2006.01)

(52) U.S. Cl.
CPC ..... *F15B 13/06* (2013.01); *F15B 11/163* (2013.01); *F15B 11/165* (2013.01); (Continued)

(58) Field of Classification Search
CPC ..... F15B 11/163; F15B 11/165; F15B 2211/20553; F15B 2211/30555; F15B 13/06; F15B 13/028
See application file for complete search history.

(56) References Cited

U.S. PATENT DOCUMENTS 5,305,789 A 4/1994 Rivolier
5,937,645 A * 8/1999 Hamamoto ..... F15B 11/165 60/422
7,818,966 B2 * 10/2010 Pack ..... F15B 11/163 60/422

FOREIGN PATENT DOCUMENTS

DE 10 2004 048 684 A1 4/2006
DE 10 2007 045 803 A1 2/2009
(Continued)

OTHER PUBLICATIONS

Rexroth Bosch Group; Load-sensing control block in sandwich plate design SB23-EHS1; RE 66134; Dec. 2013; 32 Pages; Bosch Rexroth AG, Schwieberdingen, Germany.
(Continued)

*Primary Examiner* — Eric Keasel
*Assistant Examiner* — Abiy Teka
(74) *Attorney, Agent, or Firm* — Maginot, Moore & Beck LLP

(57) ABSTRACT

A hydraulic control assembly for a plurality of consumers includes, for each consumer, a supply metering orifice configured to control fluid flow. A flow-sensing fluid-flow-path extends over detection orifices positioned hydraulically in series, whereby a detection orifice is assigned to each supply metering orifice. The fluid-flow-path is connected to a hydraulic pump upstream of the detection orifices, and a control device of the hydraulic pump downstream of the detection orifices. Each detection orifice is configured to close the fluid-flow-path upon detecting a fluid supply deficiency for a corresponding consumer, whereby the control device is configured to interact with the fluid-flow-path such that fluid flow from the hydraulic pump is increased. When no customers have a supply deficiency, the fluid-flow-path over the detection orifices is fully opened, and the control device is configured to reduce fluid flow from the hydraulic pump.

15 Claims, 6 Drawing Sheets

(52) U.S. Cl.
CPC ... *F15B 13/028* (2013.01); *F15B 2211/20553* (2013.01); *F15B 2211/3054* (2013.01); *F15B 2211/30535* (2013.01); *F15B 2211/30555* (2013.01); *F15B 2211/3111* (2013.01); *F15B 2211/3127* (2013.01); *F15B 2211/455* (2013.01); *F15B 2211/6051* (2013.01); *F15B 2211/6058* (2013.01); *F15B 2211/652* (2013.01); *Y10T 137/85986* (2015.04)

(56) References Cited

FOREIGN PATENT DOCUMENTS

| | | | |
|---|---|---|---|
| DE | 10 2009 017 506 | A1 | 12/2009 |
| DE | 10 2009 034 616 | A1 | 2/2011 |
| EP | 2 078 868 | A2 | 7/2009 |

OTHER PUBLICATIONS

Rexroth Bosch Group; LUDV control block of sandwich plate design; RE 64125; Feb. 2011; 24 Pages; Bosch Rexroth AG, Lohr am Main, Germany.
German Search Report corresponding to German Application No. 10 2013 223 288.8; mailed Jul. 28, 2014; 10 Pages; München, Germany.
European Patent and Trademark Office Search Report corresponding to EP 14190832.7, dated Apr. 16, 2015 (German language document) (5 pages).

* cited by examiner

HYDRAULIC CONTROL ASSEMBLY

This application claims priority under 35 U.S.C. §119 to patent application no. DE 10 2013 223 288.8, filed on Nov. 15, 2013 in Germany, the disclosure of which is incorporated herein by reference in its entirety.

The disclosure proceeds from a hydraulic control assembly.

BACKGROUND

DE 10 2009 034 616 A1 discloses a control assembly which takes the form of a load-sensing (LS) control. In this control the highest load pressure is signaled to a variable-displacement pump and the latter is controlled in such a way that a pump pressure exceeding the load pressure by a specific pressure differential Δp prevails in a pump line. Individual pressure compensators, which also maintain a constant pressure differential over the supply metering orifices of the hydraulic consumers having a lower load pressure at any given time, are assigned to adjustable supply metering orifices of the LS control for the consumers. The individual pressure compensators are usually arranged upstream of the supply metering orifices and restrict the fluid flow between the pump line and the supply metering orifices to such a degree that irrespective of the pump pressure the pressure upstream of the supply metering orifices still only exceeds the individual load pressure by a specific pressure differential. In the event of a supply deficit the consumer at the highest load pressure becomes slower, because the pump pressure issuing from its supply metering orifice falls and the pressure differential over this supply metering orifice thereby diminishes.

In this LS control a highest load pressure is signaled to a pump control of the variable-displacement pump usually via LS signal lines, which are interconnected by way of a shuttle valve cascade. This gives rise to a considerable outlay for mechanical devices, takes up a lot of overall space and is cost-intensive. In order to afford an adequate control pressure gradient at the supply metering orifices in these LS controls, the variable-displacement pump needs to provide an increased control pressure gradient at the individual pressure compensators, particularly in order to be able to compensate for influences on the fluid flow due to temperature changes or due to flow resistances. The control pressure gradient ensures that an adequate pressure differential prevails at the supply metering orifices in all operating states.

The Rexroth data sheet RD 66 134 discloses a hydraulic circuit diagram for the LS control explained above.

The publication U.S. Pat. No. 5,305,789 A discloses a load-independent flow distribution (LUDV) control. In a LUDV control the individual pressure compensators are arranged downstream of the supply metering orifices and restrict the fluid flow between the supply metering orifices and a load to such a degree that the pressure downstream of all supply metering orifices is equal, preferably equal to or slightly in excess of the highest load pressure. Here nothing changes in the event of a pressure supply deficit on the pressure downstream of the supply metering orifices. The pump pressure increases in the same way upstream of all supply metering orifices, so that the pressure differential varies in the same way at all supply metering orifices if the pump pressure diminishes in the event of a supply deficit, and the flow distribution between the supply metering orifices is maintained. Determination of a maximum load pressure relies on the fact that only the individual pressure compensator at the highest load is fully opened. Only in the fully opened position of the individual pressure compensator is its load pressure connected to a LS signal channel.

The Rexroth data sheet RD 64 125 discloses a hydraulic circuit diagram for the generic LUDV control.

DE 10 2007 045 803 A1 discloses a control assembly in which positions of valve spools of the individual pressure compensators are measured and the individual pressure compensators control the pressure differential at the supply metering orifice assigned to them. Here a displacement of a hydraulic pump is electrically adjusted as a function of the measuring result. This relies on the fact that only the valve spool of the individual pressure compensator at the highest load is fully opened.

The object of the disclosure, on the other hand, is to create a hydraulic control assembly which, in particular, is roughly functionally equivalent to the LS control and/or the LUDV control, which is of simple design, takes up little overall space, has a lower power requirement and is cost-effective.

SUMMARY

This object is achieved by a hydraulic control assembly.

Advantageous developments of the disclosure form the subject matter of the drawings and the claims.

According to the disclosure a hydraulic control assembly for consumers is provided. This has a supply metering orifice for each respective consumer for controlling a magnitude of a fluid flow from a hydraulic pump to the respective consumer. For this purpose each respective supply metering orifice is hydraulically connected on the inlet side to the hydraulic pump, in particular directly or indirectly via at least one further valve. A respective consumer is provided on the outlet side of each respective supply metering orifice. A respective detection orifice is advantageously assigned to each respective supply metering orifice. Here the detection orifices are arranged hydraulically in series. A flow-sensing (FS) fluid flow path extends over the detection orifices, starting from the hydraulic pump. The FS fluid flow path can therefore be connected to the hydraulic pump upstream of the detection orifices. The fluid flow path then terminates at a control device, in particular downstream of the detection orifices. The control device here serves to control a magnitude of a fluid flow from the hydraulic pump to the supply metering orifices. Each respective detection orifice is designed in such a way that if the pressure differential over each respective supply metering orifice falls below a specific value (supply deficit) it closes the FS fluid flow path. On attaining or exceeding the specific pressure differential (normal supply) the detection orifice assigned to the supply metering orifice opens the FS fluid flow path. The FS fluid flow path advantageously serves to influence the control device of the hydraulic pump for controlling the fluid flow from the hydraulic pump to the consumers or to the supply metering orifices. In particular, the FS fluid flow path therefore allows the control device to detect whether there is a supply deficit. The FS fluid flow path therefore serves for transmitting an FS signal.

This solution has the advantage that the control device of the hydraulic pump no longer uses the highest load pressure to control the fluid flow, as in the prior art explained at the outset, but instead makes the control of the hydraulic pump dependent upon the FS fluid flow path, that is to say whether the latter is opened or closed. If it is opened, that is to say if all detection orifices arranged hydraulically in series are opened, there is no supply deficit to a supply metering orifice or a consumer. If, on the other hand, a detection orifice is closed, the FS fluid flow path is blocked and the control device is able to control the hydraulic pump in such a way, for example, that the supply deficit to the supply metering orifices is counteracted.

In the hydraulic control assembly according to the disclosure, therefore, LS signal lines and a shuttle valve cascade, as are provided in the control assemblies explained at the outset in the prior art, can be omitted. This leads to a reduction in the outlay for mechanical devices and to a reduction in the overall space required. Costs are thereby reduced. In addition the hydraulic control assembly according to the disclosure has relatively low energy losses.

In a further development of the disclosure the FS fluid flow path influences the control device in such a way that a closure of the FS fluid flow path by at least one of the detection orifices leads to an increase in the fluid flow from the hydraulic pump to the consumers. An opening of the FS fluid flow path by all detection orifices on the other hand advantageously leads to a reduction of the fluid flow from the hydraulic pump to the consumers.

Each respective detection orifice may have a valve element for opening and closing the FS fluid flow path. Here the valve element is preferably acted upon in the opening direction by the fluid upstream of the supply metering orifice assigned thereto and in the closing direction by the fluid downstream of the supply metering orifice assigned thereto, and in addition by a spring force of a detection spring, especially an adjustable detection spring. This represents a simple way, in terms of mechanical devices, of closing the FS fluid flow path in the event of a supply deficit to the supply metering orifice, that is to say if the pressure differential over the supply metering orifice falls below a specific value.

The spring force of the detection spring of the detection orifice advantageously predefines the pressure differential at which the valve spool of the detection orifice is actuated in the direction of the closing position.

A pump control may preferably be provided as control device for adjusting a displacement of the hydraulic pump embodied as a variable-displacement pump. Alternatively it is feasible for the control device to be an inlet pressure compensator of the hydraulic pump embodied as a constant-displacement pump.

The pump control has the advantage that the variable-displacement pump can be turned down when the FS fluid flow path is opened and there is therefore no supply deficit at the supply metering orifices. If the FS fluid flow path is closed, on the other hand, the variable-displacement pump can be turned by the pump control in the direction of an increased displacement. The FS fluid flow path also allows the control device to be designed without a volumetric flow regulator.

In a further development of the disclosure each respective supply metering orifice may be embodied as a continuously adjustable directional control valve. In a neutral position this may close a fluid connection between the consumer assigned to it and the hydraulic pump, and in switching positions it may open a fluid connection between the consumer assigned to it and the hydraulic pump. The directional control valve therefore serves to adjust an opening cross section.

In a preferred embodiment, which may be based, in particular, on a LS control with individual pressure compensators, an individual pressure compensator is assigned to each respective supply metering orifice. Said pressure compensator is preferably used to maintain an approximately constant pressure differential over the supply metering orifice. Besides a respective detection orifice, therefore, a respective individual pressure compensator is additionally provided. Here the individual pressure compensator may be connected to the supply metering orifice on the inlet or outlet side. In contrast to the prior art, the provision of an individual pressure compensator in addition to the detection orifice obviates the need for an excess pressure.

In a further development of the disclosure at least one individual pressure compensator is formed together with the assigned detection orifice as an individual valve having a common valve element. All individual pressure compensators are preferably formed as individual valves with the detection orifices assigned to them. This has the advantage that only one valve need be used, which simplifies the mechanical devices needed and is cost-effective.

The individual valve may advantageously be connected to the supply metering orifice on the inlet or outlet side.

The valve element of each respective individual valve is preferably embodied as a valve spool. This may have a basic position and be displaceable from this position in the direction of first switch switching positions. In addition it may be displaceable in the direction of second switching positions, which adjoin the first switching positions. In the various positions the valve spool may advantageously fulfill the functions of the detection orifice and the individual pressure compensator. The FS fluid flow path may therefore be opened in the first and second switching positions and closed in the basic position. Additionally, in the second switching positions a fluid connection between the hydraulic pump and the consumer may be closed. In the first switching positions the fluid connection between the hydraulic pump and the consumer may then be restricted or fully opened. In the basic position the fluid connection between the hydraulic pump and the consumer is then preferably fully opened. With a normal supply to the supply metering orifice, the pressure differential over the supply metering orifice is controlled by the individual valve in the first and second switching positions, in which the FS fluid flow path is fully opened. Here the pump control may turn the pivotable pump down. In the event of a supply deficit, on the other hand, the valve element of the individual valve is in the basic position, the FS fluid flow path being closed and the fluid connection from the hydraulic pump to the supply metering orifice and to the consumer being fully opened. Here the pump control may then turn the variable-displacement pump in the direction of an increased displacement.

In adjusted operation the individual valve and the FS fluid flow path allow the valve spool of the individual valve of the consumer at the highest load to be positioned preferably in the area of its first switching positions, since in contrast to the prior art the hydraulic pump does not deliver any excess pressure. This leads to an energy saving, since a control reserve for so-called extreme situations is no longer necessary.

In a further development of the individual valve the valve element may be acted upon in the direction of the basic position by the spring force of the detection spring and by the fluid downstream of the assigned supply metering orifice. The valve element may be acted upon in the direction of the first and second switching positions by the fluid upstream of the supply metering orifice assigned to it.

In a further preferred embodiment, which is based in particular on a LUDV control, the control assembly according to the disclosure may be formed with an individual pressure compensator connected to the supply metering orifice on the outlet side. A FS fluid flow path can therefore also be provided in a control assembly which is basically embodied as a LUDV control assembly.

In a further preferred embodiment an individual pressure compensator having a valve spool may therefore be connected to each respective supply metering orifice on the outlet side. In a basic position this may close a fluid connection between the supply metering orifice and the assigned consumer and starting from the basic position and moving in the direction of the first switching positions may afford restricted opening of the fluid connection between the supply metering orifice and the assigned consumer. Starting from the first switching positions the valve switch, moving further in the direction of the second switching positions, may fully open the fluid connection between the supply metering orifice and the assigned consumer.

The valve spool of each respective individual pressure compensator of the further embodiment may be further acted upon in the direction of the first and second switching positions by the fluid downstream of the supply metering orifice and in the direction of the basic position by the highest load pressure of the consumers.

In addition, the individual pressure compensators of the further preferred embodiment may be connected to a common LS line. The valve spool of each respective individual pressure compensator may then afford a restricted connection, downstream of the supply metering orifice, to a consumer line connected to the consumer. In the first switching positions and in the basic position the valve spool may close the connection between the LS line and the consumer line. Via the LS line the valve spool may furthermore be acted upon in the direction of the basic position by the highest load pressure of the consumers.

In a further development of the disclosure the pump control may preferably comprise an adjusting cylinder for adjusting the displacement of the variable-displacement pump. Here the adjusting cylinder is preferably controlled by a control valve.

A piston of the adjusting cylinder may furthermore define a cylinder chamber, which can be charged with fluid in order to reduce the displacement of the variable-displacement pump. In order to increase the displacement of the variable-displacement pump, fluid can be discharged from the cylinder chamber. For charging fluid, the cylinder chamber is in particular connected directly to the FS fluid flow path, especially through a restricted connection.

The control valve may comprise a valve spool, which is acted upon in the direction of a basic position by a spring force of a valve spring, in particular an adjustable spring. It may be acted upon in the direction of switching positions by fluid from an outlet side of the hydraulic pump and therefore acted upon by a pump pressure. In the basic position a fluid connection is preferably opened between the FS fluid flow path and the cylinder chamber, and closed between the outlet side of the hydraulic pump and the cylinder chamber. In the switching positions the fluid connection may be closed between the FS fluid flow path and the cylinder chamber and opened between the outlet side of the hydraulic pump and the cylinder chamber.

The FS fluid flow path is advantageously connected via a restrictor to a tank, so that a defined pressure prevails in the FS fluid flow path even when a detection orifice is closed.

The hydraulic control assembly may be provided in a valve block. It is feasible for the valve block to be formed from valve plates, the valves for each respective consumer being provided in each respective valve plate.

BRIEF DESCRIPTION OF THE DRAWINGS

Preferred embodiments are explained in more detail below with reference to drawings, of which.

DETAILED DESCRIPTION

Figure 1:
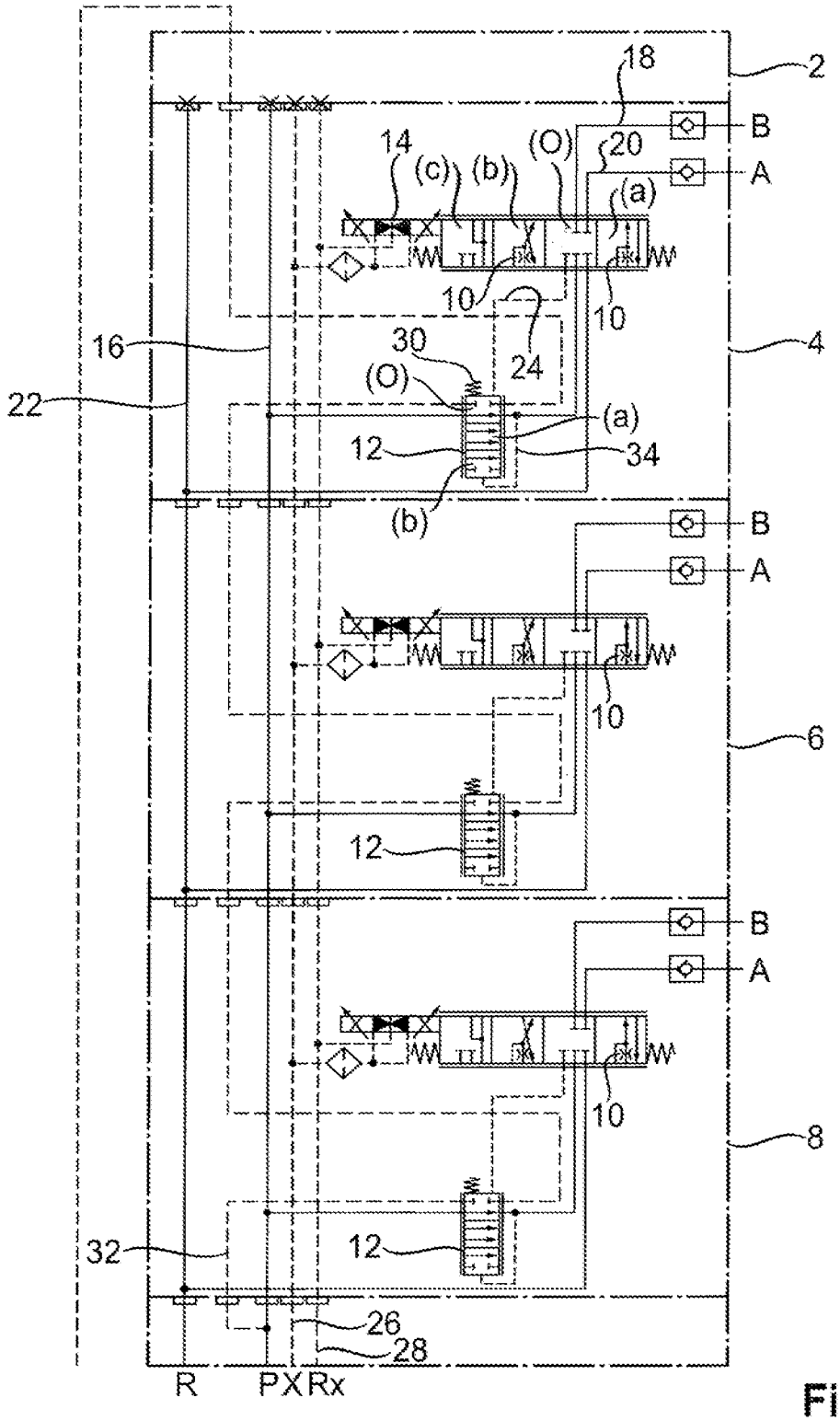
FIG. 1 shows a hydraulic circuit diagram of a control assembly according to the disclosure in a first exemplary embodiment.

According to FIG. 1 the hydraulic control assembly 1 comprises a valve block 2, which comprises valve plates 4, 6 and 8. Each respective valve plate 4 to 8 comprises two working connections A, B for the connection of a hydraulic consumer, such as a hydraulic cylinder, for example. Here the valve plates 4 to 8 are of identical design and each comprise a supply metering orifice 10 and an individual valve 12. Here each respective individual valve 12 forms an individual pressure compensator, which is connected to the inlet side of the respective supply metering orifice 10, and a detection orifice according to the disclosure.

The design of the supply metering orifices 10 is explained with reference to the valve plate 4. The supply metering orifice 10 is designed as a continuously adjustable 5/4 directional control valve. Here a valve spool of the supply metering orifice 10 is spring-centered in a neutral position 0. By means of a hydraulic actuator 14 the valve spool can be shifted from the neutral position 0 in the direction of a first switching position a or in the opposite direction from the neutral position 0 in the direction of second switching positions b. If the valve spool is shifted further from the second switching positions b it reaches free-flow or floating positions c. In the first switching position (a) a fluid connection is opened between an inlet line 16, which extends from a hydraulic pump not represented in FIG. 1, and a working line 18 to the working connection B. In addition a fluid connection is opened between a working line 20 connected to the working connection A, and an outlet line 22 connected to a tank (not represented). In the first switching positions (a) a pressure is also picked off downstream of the supply metering orifice 10 via a branch line 24. The branch line 24 here is connected to the individual valve 12. In contrast to the first switching positions a, in the second switching positions b of the supply metering orifice 10 the working line 20 is connected to the inlet line 16 and the working line 18 is connected to the outlet line 22. In the free-flow or floating positions c both working connections 18 and 20 are connected to the outlet line 22 and the inlet line 16 and the branch line 24 are closed. In the neutral position 0 all lines are separated from one another. Control lines 26 and 28 are provided for controlling the hydraulic actuator 14. Alternatively it is feasible for the supply metering orifice 10 to be actuated electromagnetically or manually.

The individual valve 12 is likewise explained in more detail with reference to the valve plate 4. It is designed as a continually adjustable 4/3 directional control valve. A spring force of a detection spring 30 acts upon a valve spool in the direction of a basic position 0. From the basic position 0 it can be shifted in the direction of first switching positions a. Further to the switching positions a, it can be shifted in the direction of second switching position b. A flow-sensing (FS) fluid flow path 32 extends over the individual valves 10 of the valve plates 4 to 8. The individual valves 12 are arranged in series in respect of this FS fluid flow path 32. Here in the basic position 0 of the individual valve 12 the FS fluid flow path 32 is closed and in the first and second switching positions a,b it is opened. The FS fluid flow path 32 is therefore opened only when all valve spools of the individual valves 12 are not in their neutral position 0. If, on the other hand, one or more of the valve spools of the individual valves 12 is in the basic position 0, the FS fluid flow path 32 is closed. The FS fluid flow path 32 is connected to the inlet line 16 upstream of the individual valves 12 and extends further over the individual valve 12 of the valve plate 8 to the individual valve 12 of the valve plate 6 and thence to the individual valve 12 of the valve plate 4. Downstream of the last individual valve 12 of the valve plate 4 the FS fluid flow path 32 is then connected to a pump control (not represented) of a hydraulic pump embodied as a variable-displacement pump.

As already explained above, the valve spool of each respective individual valve 12 is acted upon by the spring force of the detection spring 30 in the direction of the basic position 0. In addition it is acted upon in the direction of the basic position 0 by the fluid in the branch line 24 and therefore by the pressure downstream of the supply metering orifice 10. In the opposite direction, that is to say in the direction of the first and second switching positions a,b, the valve spool is acted upon, via a control line 34, by the fluid from the inlet line 16 downstream of the individual valve 12 and upstream of the supply metering orifice 10. In the basic position 0 the FS fluid flow path 32 is closed and the inlet line 16 to the supply metering orifice 10 is fully opened. In the first switching positions a, on the other hand, the FS fluid flow path 32 is opened and the inlet line 16 to the supply metering orifice is likewise fully opened. In the second switching positions b the FS fluid flow path 32 is then opened again and the inlet line 16 to the supply metering orifice 10 is closed.

The hydraulic control assembly according to the disclosure in FIG. 1 differs from conventional LS control assemblies particularly in the provision of the FS fluid flow path 32, which can be opened and closed by the detection orifices of the individual valves 12. The FS fluid flow path 32 therefore serves for transmitting an FS signal, which is explained below, for which reason a load pressure signal, which is relayed to a pump control via LS signal lines and a shuttle valve cascade, for example, is no longer necessary. According to FIG. 1, instead of individual pressure compensators the individual valves 12 are provided, which unlike individual pressure compensators have an additional control edge for controlling the FS fluid flow path.

In explaining the operating principle of the control assembly 1 in FIG. 1 it is first assumed that the variable-displacement pump (not shown) is in operation and the supply metering orifices 10 are in their neutral position 0 shown. As a result the valve spools of the individual valves 12 are located in the second switching position b, so that the FS fluid flow path 32 is opened. Fluid is then fed via this path from the inlet line 16 to the pump control of the variable-displacement pump, which serves as FS signal. The FS fluid flow path 32 here interacts with the pump control in such a way that with the FS fluid flow path 32 opened (FS signal open) the variable-displacement pump is turned down.

It is next assumed that the supply metering orifice 10 of the valve plate 8 is situated in its second switching position b, so that a consumer connected to the working connections A, B of the valve plate 8 is supplied with fluid via the inlet line 16. The individual valves 12 of the valve plates 4 and 6 are in the second switching position b. If the consumer connected to the valve plate 8 now has a supply deficit, that is to say the pressure differential over the supply metering orifice 10 is below a predefined pressure differential, the valve spool of the individual valve 12 of the valve plate 8 is shifted into the basic position 0. The FS fluid flow path 32 is accordingly closed by the individual valve 12 of the valve plate 8. Therefore no fluid passes from the inlet line 16 to the pump control via the FS fluid flow path 32. Here the FS fluid flow path 32 interacts with the pump control in such a way that in this case the variable-displacement pump is turned in the direction of an increase in the displacement. In this case the individual valve 12 of the valve plate 8 is fully or almost fully opened in respect of the inlet line 16 to the supply metering orifice 10, for which reason it has minimal hydraulic losses, in contrast to a conventional LS control assembly of prior art.

In the absence of a continuing supply deficit of the consumer connected to the valve plate 8, the valve spool of the individual valve 12 of the valve plate 8 is moved into its first switching position a. The FS fluid flow path 32 is therefore opened again and at the same time the inlet line 16 to the supply metering orifice 10 of the valve plate 8 is fully or almost fully opened, which again leads to minimal hydraulic losses. The opened FS fluid flow path 32 causes the pivotable pump to be turned down again.

It is now assumed that the hydraulic consumers connected to the valve plates 6 and 8 are operated in parallel. For this purpose both the valve spool of the supply metering orifice 10 of the valve plate 6 and the valve spool of the supply metering orifice 10 of the valve plate 8 are situated in the second switching positions b, for example. Here the pressure differential of the supply metering orifices 10 of the valve plates 6 and 8 are adjusted via the individual valves 12. The consumer connected to the valve plate 6 should be the consumer at the highest load, which is why the individual valve 12 of the valve plate 6 controls the FS fluid flow path 32. For this purpose its valve spool is situated in the basic position 0 or in the first switching position a. Here the variable-displacement pump is controlled by the pump control so that the necessary pressure differential prevails at the supply metering orifices 10. The connection in the first valve plate 6 between the inlet line 16 and the supply metering orifice 10 is therefore fully opened, which leads to minimal hydraulic losses. The other individual valve 12 of the valve plate 8 with the consumer at a lower load then controls the pressure differential via the supply metering orifice 10 of the valve plate 8 in the conventional way, in that its valve spool is in the switching positions a or b. The FS fluid flow path 32 is therefore fully opened via the individual valve 12 of the valve plate 8.

The hydraulic control assembly 1 according to the disclosure in FIG. 1 therefore means that in the absence of a supply deficit to the assigned supply metering orifice 10 each individual valve 12 relays the FS signal via the FS fluid flow path 32. If there is no overall supply deficit, the FS signal is transmitted via the opened FS fluid flow path 32 to the pump control, which correspondingly turns down the variable-displacement pump. If only one hydraulic consumer is used, the individual valve 12 assigned to this is used for controlling the FS fluid flow path 32 and therefore for controlling the variable-displacement pump, in order to adjust the pump pressure commensurately. If multiple consumers are operated, the individual valve 12 of the consumer at the highest load is used for controlling the FS fluid flow path 32 and therefore for controlling the variable-displacement pump, and the other individual valves 12 are used as conventional individual pressure compensators.

Figure 2:
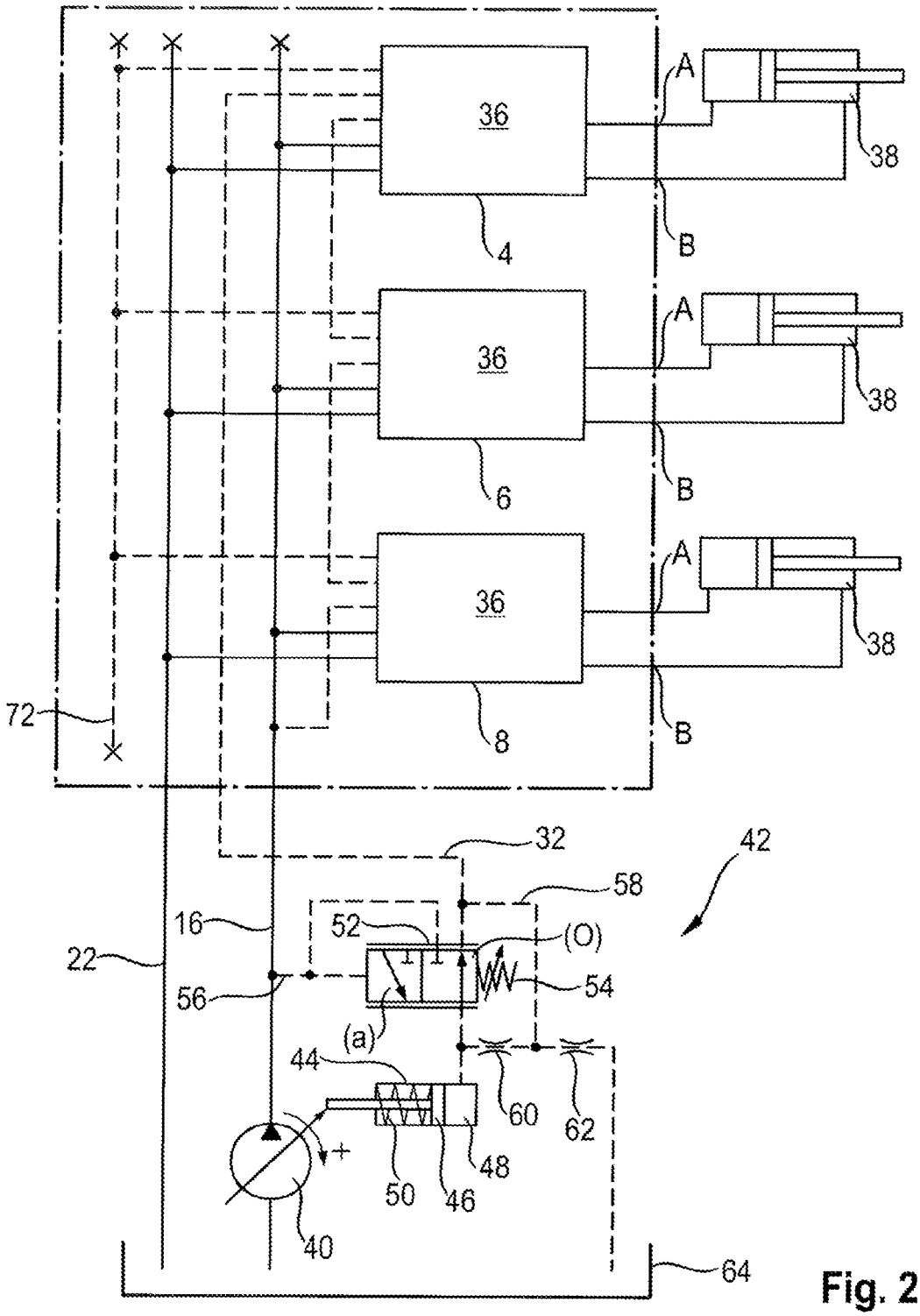
FIG. 2 shows a further hydraulic circuit diagram of the control assembly according to the disclosure.

FIG. 2 shows a further representation of the hydraulic control assembly 1. Here the valve plates 4, 6 and 8 are represented as blocks. They serve as locators for the portions 36 of hydraulic control assemblies 1 in different embodiments depicted in FIGS. 3-6.

FIG. 2 also shows examples of hydraulic consumers 38. Here they are differential cylinders, which are each connected to the working co0nnections A, B of the valve plates 4-8.

In addition FIG. 2 shows a variable-displacement pump 40 having a pump control 42. This comprises an adjusting cylinder 44 with a piston 46. This defines a cylinder chamber 48. Via the cylinder chamber 48 fluid is capable of acting on the piston 46 in the direction for turning down the variable-displacement pump 40. A spring force of a spring 50 acts on the piston 46 in the opposite direction. The pump control 42 further comprises a control valve 52, which is embodied as a continuously adjustable 3/2 directional control valve. A spring force of an adjustable valve spring 54 acts on a valve spool in the direction of a basic position 0. In the opposite direction to the switching positions a fluid in the inlet line 16 is capable of acting on the valve spool via a control line 56, the inlet line 16 being connected to the variable-displacement pump 40 on the outlet side. In the basic position 0 a fluid connection between the FS fluid flow path 32 and the cylinder chamber 48 of the adjusting cylinder 44 is opened by the control valve 52. In the switching positions a, on the other hand, this connection is closed whilst a fluid connection between the inlet line 16 and the cylinder chamber 48 is opened. Here the FS fluid flow path 32 is connected to the control valve 52 downstream of the detection orifices not shown in FIG. 2. Also extending from the FS fluid flow path 32 downstream of the detection orifices not shown in FIG. 2 is a branch line 58, which is directly connected to the cylinder chamber 48 by a restrictor 60. A further restrictor 62, via which the branch line 58 and therefore the FS fluid flow path 32 is connected to a tank 64, is provided hydraulically in parallel with the restrictor 60.

Figure 3:
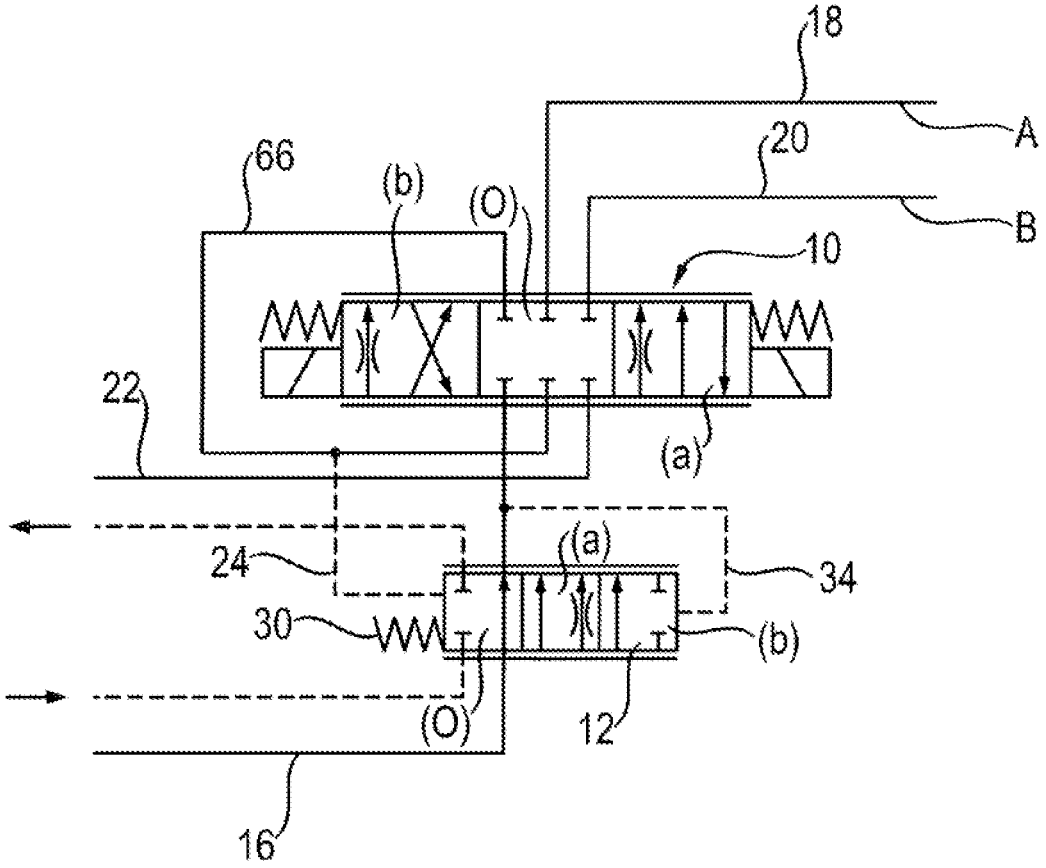
FIG. 3 shows a hydraulic circuit diagram of a portion of the control assembly according to a second exemplary embodiment.

FIG. 3 represents the portion 36 of a second embodiment of the control assembly 1. Viewed in conjunction with FIG. 2, the portion 36 is provided for the valve plates 4-8. In contrast to the embodiment in FIG. 1 the supply metering orifice 10 is embodied as a 6/3 directional control valve. A valve spool of the metering orifice 10 is spring-centered in a neutral position 0. It can be shifted from the neutral position 0 in the direction of first switching positions a. In the opposite direction it can be shifted from the neutral position 0 in the direction of second switching positions b. In the first switching positions (a) the inlet line 16 is connected via the supply metering orifice 10 to a connecting line 66, which again in the first switching position a is connected via the metering orifice 10 to the working line 16 for the working connection A. In addition, in the first switching positions (a) the working line 20 for the working connection B is connected to the outlet line 22. In the neutral position 0 all lines are separated from one another. In the second switching positions b, on the other hand, the inlet line 16 is again connected via the metering orifice 10 to the connecting line 66, the latter then being further connected via the metering orifice 10 to the working line 20 for the working connection B. The working line 18 is then connected to the outlet line 22.

The branch line 24 for the individual valve 12 branches off from the connecting line 60. The fluid downstream of the supply metering orifice 12 therefore continues to act upon the valve spool of the individual valve 12 in the direction of its basic position 0. In the opposite direction it is acted upon by the fluid from the control line 34 between the individual valve 12 and the supply metering orifice 10. In contrast to FIG. 1, the intention with the individual valve 12 in FIG. 3 is that in the first switching positions a of the valve spool the inlet line 16 should have a restricted connection to the supply metering orifice 10.

An operating principle of portion 36 of the control assembly 1 according to FIG. 3 here substantially corresponds to the operating principle of the control assembly in FIG. 1.

In the operating description of the hydraulic control assembly according to FIGS. 2 and 3 it is assumed that all supply metering orifices 10 for the consumers 38 are at least partially opened, and that the valve spools of the individual valves 12 are situated in the switching positions a or b. Accordingly the FS fluid flow path 32 is opened, so that the cylinder chamber 48 of the adjusting cylinder 44 is connected to the inlet line 16 via the FS fluid flow path 32, the branch line 58 and the restrictor 60. Irrespective of the position of the valve spool of the control valve 52, therefore, the pressure prevailing on the piston 46 approximates to the feed pressure of the variable-displacement pump 40. The piston 46 therefore moves in the direction of an enlargement of the cylinder chamber 48, which leads to turning down of the variable-displacement pump 40. In their function as individual pressure compensators the individual valves 12 control the pressure differential over the assigned supply metering orifice, in such a way that this remains substantially constant and corresponds to a pressure equivalent of the spring force of the detection spring 30. If the fluid flow delivered by the variable-displacement pump 40 is no longer sufficient, with the result that at least one supply metering orifice 10 has a supply deficit, the valve spool of that individual valve 12 having a metering orifice 10 with a supply deficit is shifted in the direction of its basic position 0. The valve spool of the individual valve 12 is therefore shifted into its basic position 0 if the pressure differential of the assigned metering orifice 10 is less than the pressure equivalent of the detection spring 30. The FS fluid flow path 32 is therefore closed. The FS fluid flow path 32 is then connected to the tank 64 via the branch line 58. The control valve 52 then adjusts a feed pressure of the variable-displacement pump 40 to the value set by the valve spring 54, which corresponds in particular to the maximum admissible feed pressure. This in turn leads to an increase in the displacement of the variable-displacement pump 40, until there is no longer any supply deficit.

If the valve spool of a supply metering orifice 10 is situated in the neutral position 0, the valve spool of the assigned individual valve 12 is shifted into its second switching position b. In this position the FS fluid flow path 32 is opened in respect of this individual valve 12. If all supply metering orifices 10 are in the neutral position 0, a displacement of the variable-displacement pump 40 is adjusted to the smallest possible value, so that energy losses are as low as possible when the consumers 38 are at a standstill.

Figure 4:
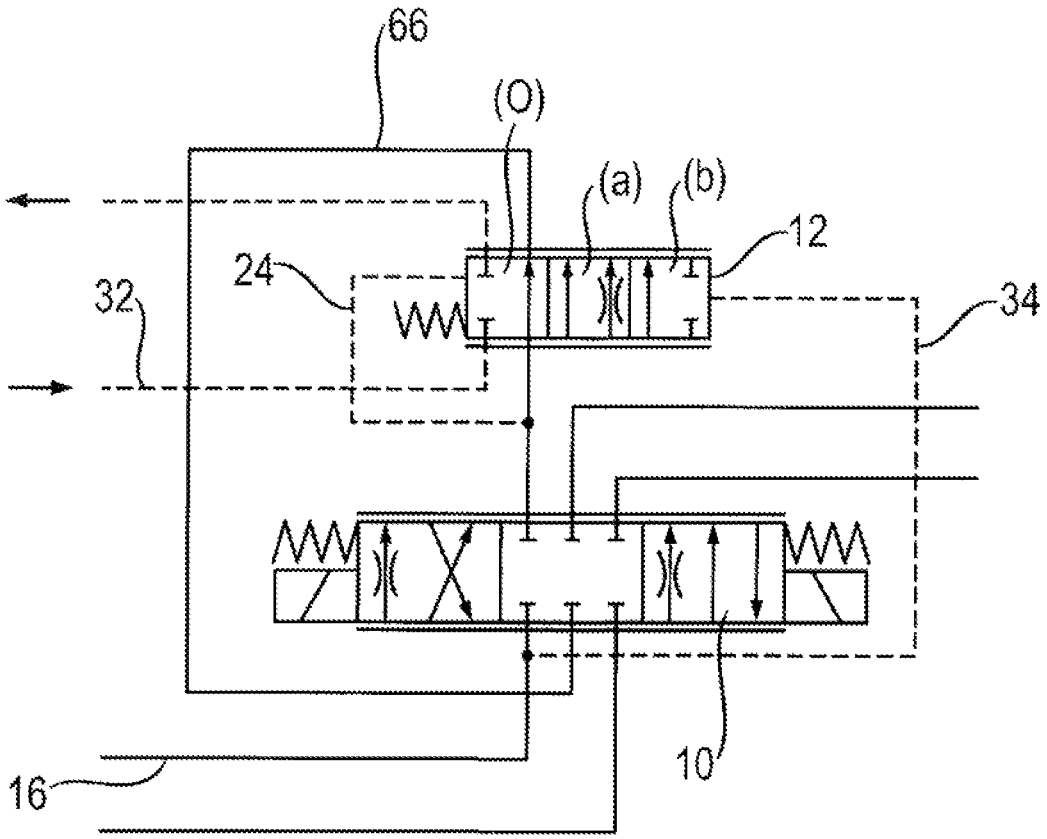
FIG. 4 shows a hydraulic circuit diagram of a portion of the control assembly according to a third exemplary embodiment.

FIG. 4 shows a portion 36 of a hydraulic control assembly 1 according to a third exemplary embodiment. Here, in contrast to FIG. 3, each respective individual valve 12 is connected to the outlet side of the supply metering orifice 10. The individual valve 12 is arranged in the connecting line 66. In the basic position 0 of the individual valve 12 the connecting line 66 is fully opened. In the first switching position a, on the other hand, the opening of the connecting line 66 is restricted and in the switching position b it is closed. The FS fluid flow path 32 is controlled by the individual valve 12, as in the first and second exemplary embodiments. Fluid acting on the valve spool of the individual valve 12, via the branch line 24, which branches off from the connecting line 66 between the individual valve 12 and the supply metering orifice 10, acts in the direction of the basic position 0. In the opposite direction fluid is capable of acting thereon via the control line 34, which branches off from the inlet line 16 upstream of the supply metering orifice 10.

An operating principle of the control assembly according to FIG. 4 substantially corresponds to the operating principle of the control assembly according to FIG. 3.

Figure 5:
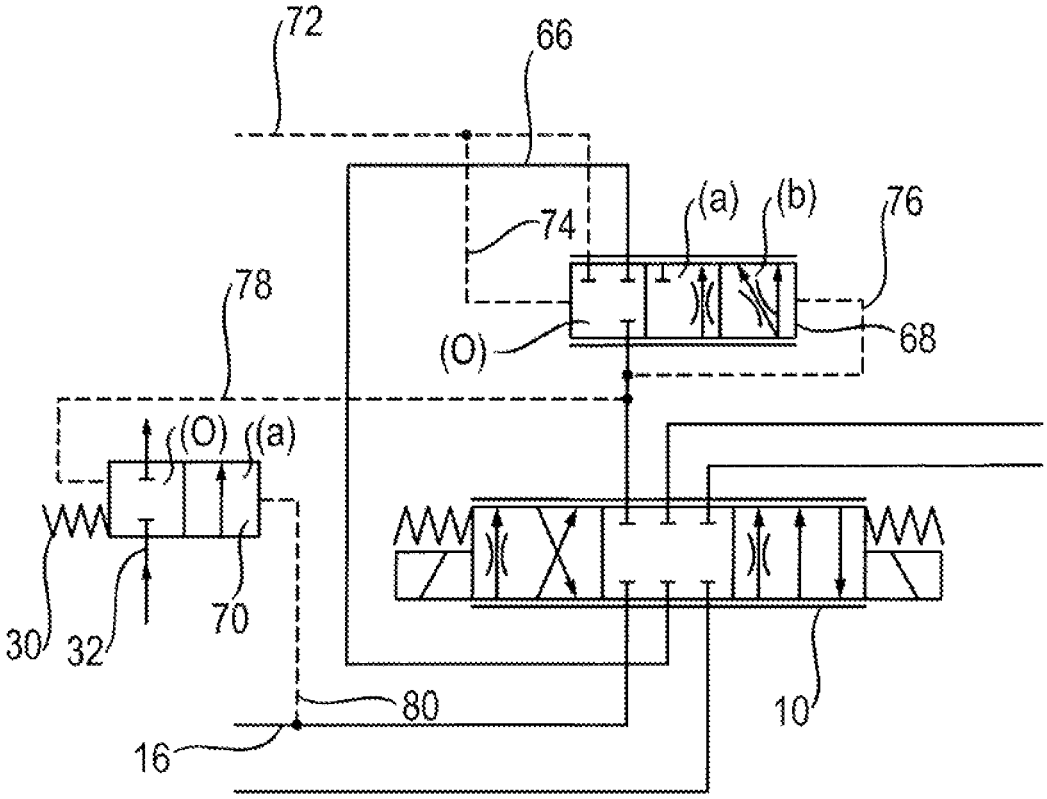
FIG. 5 shows a hydraulic circuit diagram of a portion of the control assembly according to a fourth exemplary embodiment and FIG. 6 shows a hydraulic circuit diagram of a portion of the control assembly according to a fifth exemplary embodiment.

FIG. 5 shows the portion 36 of the control assembly 1 in FIG. 2 according to a fourth exemplary embodiment. Here this is based on a LUDV control assembly with individual pressure compensator connected on the outlet side. The supply metering orifice 10 is embodied according to FIGS. 3 and 4. Instead of a separate individual valve 12, an individual pressure compensator 68 and a detection orifice 70 are provided separately from one another. Here the individual pressure compensator 68 is arranged in the connecting line 66. It is designed as a continuously adjustable 3/3 direction control valve. Here the valve spool of the individual pressure compensator 68 can be brought into a basic position 0. From this position it can be shifted in the direction of first switching positions (a) and further thereto on in the direction of second switching positions b. A load pressure signal line 72 is connected to the individual pressure compensator 68. Branching off from this is a control line 74, fluid from which acts on the valve spool of the individual pressure compensator 68 in the direction of its basic position 0. In the opposite direction fluid acts on the valve spool by way of a control line 76, which branches off from the connecting line 66 between the supply metering orifice 10 and the individual pressure compensator 68. In its first switching positions a of the individual pressure compensator 68 the connecting line 66 has a restricted opening. In the second switching positions b the connecting line 66 is fully opened and the load pressure signal line 72 additionally has a restricted connection to the connecting line 66. In the basic position 0 the connecting line 66 is closed and the load pressure signal line 72 is separated from the latter. The individual pressure compensators 68 of the valve plates 4 to 8 in FIG. 2 therefore together share the load pressure signal line 72, see also FIG. 2, the highest load pressure then prevailing in this line.

The detection orifice 70 is designed as a 2/2 directional control valve. A valve spool of the detection orifice 40 is acted upon by the spring force of the detection spring 30 in the direction of a basic position 0. It can be shifted from the basic position 0 in the direction of a switching position (a) against the spring force. In addition to the spring force, fluid from the connecting line 66 between the supply metering orifice 10 and the individual pressure compensator 66 acts on the valve spool by way of a control line 78 in the direction of its basic position 0. In the opposite direction, that is to say in the direction of the switching position a, fluid from the inlet line 16 upstream of the supply metering orifice 10 is capable of acting on the valve spool via a control line 80. In the basic position 0 the detection orifice 70 closes the FS fluid flow path 32. In the switching position a, on the other hand, the FS fluid flow path 32 is opened.

In the absence of a supply deficit, the control assembly is used in the normal way according to FIG. 2 in conjunction with FIG. 5. The FS fluid flow path 32 is then opened via the detection orifice 70. In the event of a supply deficit, however, the detection orifice 70 closes the FS fluid flow path 32, so that the variable-displacement pump 40 according to the embodiments in FIGS. 3 and 4 again increases its displacement. Without the detection orifice 70, in the event of a supply deficit the variable-displacement pump 40 would not receive any information that the fluid flow was insufficient. In the embodiment according to FIG. 5, the individual pressure compensator 68, which is assigned to the consumer at the highest load pressure, is fully opened, which leads to low energy losses as in the preceding embodiments.

Figure 6:
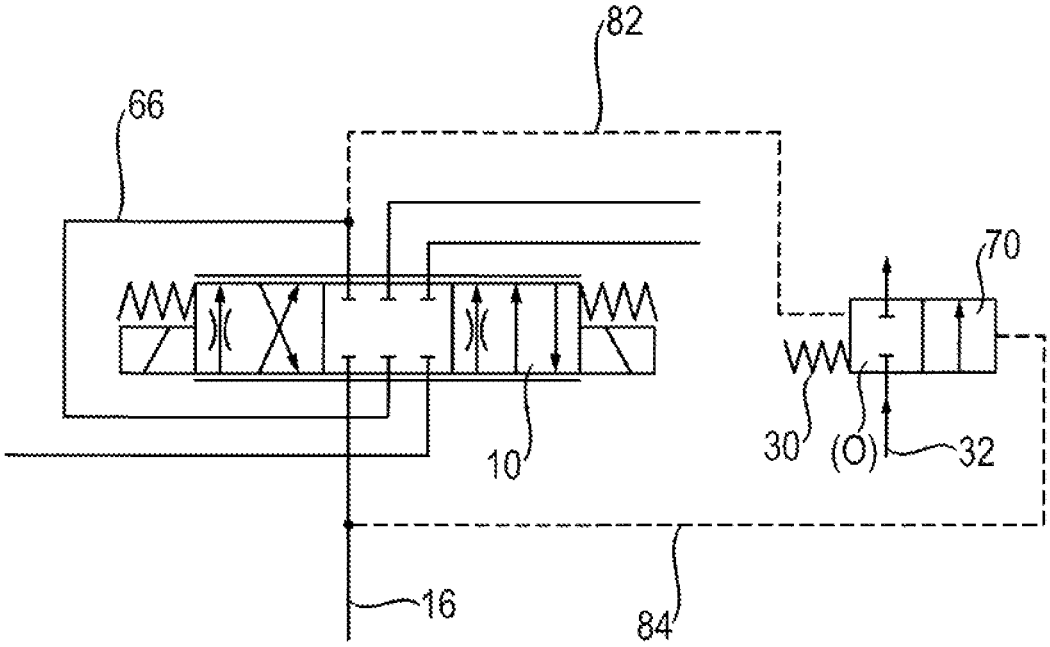

The portion 36 according to FIG. 6 in conjunction with FIG. 2 shows a further embodiment of a control assembly 1. Here, in contrast to the preceding embodiments, only the supply metering orifice 10 is provided, together with the detection orifice 70. Here the supply metering orifice 10 is embodied according to FIG. 3. The detection orifice 70 is embodied according to FIG. 5. Fluid from the connecting line 66 acts on the valve spool of the detection valve 70 in the direction of the basic position 0, in that a control line 82 branches off from said connecting line. In the opposite direction fluid from the inlet line 16 upstream of the supply metering orifice 10 acts on the valve spool via a control line 84 branching off from said inlet line.

If the pressure differential over the supply metering orifice 10 according to FIG. 6 is less than the pressure equivalent of the detection spring 30, the FS fluid flow path 32 is closed by the detection valve 70. The variable-displacement pump 40 in FIG. 2 is then shifted in the direction of an increase in displacement.

A hydraulic control assembly for a plurality of consumers is disclosed. Here a supply metering orifice for controlling a fluid flow is provided for each respective consumer. A detection orifice is assigned to each respective supply metering orifice. Here the detection orifices are arranged hydraulically in series. A flow-sensing (FS) fluid flow path here extends over the detection orifices. Upstream of the detection orifices the fluid flow path is connected to the hydraulic pump and downstream of the detection orifices it is connected to a control device of the hydraulic pump. If a consumer has a fluid supply deficit, the corresponding detection orifice closes the flow-sensing fluid flow path. Here the control device interacts with this FS fluid flow path in such a way that the fluid flow from the hydraulic pump is thereby increased. If none of the consumers has a supply deficit, the FS fluid flow path over the detection orifices is fully opened and the control device reduces the fluid flow from the hydraulic pump.

LIST OF REFERENCE NUMERALS

1 control assembly
2 valve block
4 valve plate
6 valve plate
8 valve plate
10 supply metering orifice
12 individual valve
14 actuator
16 inlet line
18 working line
20 working line

22 outlet line
24 branch line
26 control line
28 control line
30 detection spring
32 FS fluid flow path
34 control line
36 portion
38 consumer
40 variable-displacement pump
42 pump control
44 adjusting cylinder
46 piston
48 cylinder chamber
50 spring
52 control valve
54 valve spring
56 control line
58 branch line
60 restrictor
62 restrictor
64 tank
66 connecting line
68 individual pressure compensator
70 detection orifice
72 load pressure signal line
74 control line
76 control line
78 control line
80 control line
82 control line
84 control line
A,B working connection
0ˆ neutral position, basic position
a first switching position
b second switching position
c free-flow position

What is claimed is:

1. A hydraulic control assembly for at least two consumers, comprising:

a hydraulic pump;

a respective supply metering orifice for each of the consumers, wherein each supply metering orifice is configured to control a consumer fluid flow for a corresponding consumer and has an inlet side connected to the hydraulic pump;

a plurality of detection orifices positioned hydraulically in series with one another in a flow-sensing fluid flow path, wherein each supply metering orifice is assigned a respective detection orifice of the plurality of detection orifices; and a control device configured to control a pump fluid flow from the hydraulic pump to the supply metering orifices, wherein:

the flow-sensing fluid flow path extends from the hydraulic pump, through the plurality of detection orifices in series, and to the control device, and fluid from the flow-sensing fluid flow path influences the control device for controlling the pump fluid flow, when a pressure differential over one of the supply metering orifices falls below a threshold, the respective detection orifice closes the flow-sensing fluid flow path, and when a pressure differential over one of the supply metering orifices exceeds the threshold, the respective detection orifice opens the flow-sensing fluid flow path.

2. The hydraulic control assembly according to claim 1, wherein the fluid from the flow-sensing fluid flow path influences the control device in such a way that:

a closure of the flow-sensing fluid flow path by any one of the detection orifices results in an increase in the pump fluid flow from the hydraulic pump; and an opening of the flow-sensing fluid flow path by all of the detection orifices results in a reduction of the pump fluid flow from the hydraulic pump.

3. The hydraulic control assembly according to claim 1, wherein, each detection orifice has a respective valve element that is configured to open and close the flow-sensing fluid flow path, and which is acted upon in an opening direction by fluid upstream of the supply metering orifice to which the respective orifice is assigned, and in a closing direction by fluid downstream of the supply metering orifice to which the respective orifice is assigned and by a spring force of a detection spring.

4. The hydraulic control assembly according to claim 1, wherein:

the hydraulic pump is a variable displacement pump; and the control device is a pump control configured to adjust a displacement of the variable displacement pump.

5. The hydraulic control assembly according to claim 4, wherein:

the pump control includes an adjusting cylinder configured to adjust the displacement of the variable displacement pump; and the adjusting cylinder is controlled by a control valve and the fluid in the fluid-sensing fluid flow path.

6. The hydraulic control assembly according to claim 5, wherein the adjusting cylinder includes a piston which defines a cylinder chamber that is directly connected to the fluid-sensing fluid flow path, and that is configured to:

reduce the displacement of the variable displacement pump by being charged with fluid; and increase the displacement of the variable displacement pump by being discharged.

7. The hydraulic control assembly according to claim 6, wherein:

the control valve includes a valve spool which is acted upon in a direction of a basic position by a spring force of a valve spring, and is acted upon in a direction of a switching position by fluid from an outlet side of the hydraulic pump;

when the valve spool is in the basic position, a fluid connection between the fluid-sensing fluid flow path and the cylinder chamber is open and a fluid connection between the outlet side of the hydraulic pump and the cylinder chamber is closed; and when the valve spool is in the switching position, the fluid connection between the fluid-sensing fluid flow path and the cylinder chamber is closed and the fluid connection between the outlet side of the hydraulic pump and the cylinder chamber is open.

8. The hydraulic control assembly according to claim 1, further comprising a respective individual pressure compensator assigned to each supply metering orifice and configured to maintain a constant pressure differential over the supply metering orifice to which the respective individual pressure compensator is assigned.

9. The hydraulic control assembly according to claim 8, wherein at least one individual pressure compensator is formed together with the respective detection orifice assigned to the supply meter orifice to which the at least one individual pressure compensator is assigned in such a way that the at least one individual pressure compensator and the respective detection orifice are formed together as an individual valve having a common valve element.

10. The hydraulic control assembly according to claim 9, wherein the individual valve is connected to either the inlet side or an outlet side of the supply meter orifice to which the individual valve is assigned.

11. The hydraulic control assembly according to claim 10, wherein:

the common valve element of each individual valve is a valve spool that has a basic position and that is configured to be shifted from the basic position in a direction of a first switching position and further in the direction to a second switching position, wherein:

the flow-sensing fluid flow path is opened in the first and second switching positions, and is closed in the basic position; and a fluid connection between the consumer corresponding to the supply meter orifice to which the individual valve is assigned and the hydraulic pump is closed in the second switching position, is restrictedly opened in the first position, and is fully open in the basic position.

12. The hydraulic control assembly according to claim 11, wherein each valve spool is acted upon in a direction of the basic position by a spring force of a detection spring and by fluid downstream of the corresponding supply metering orifice, and is acted upon in the direction of the first and second switching positions by fluid upstream of the corresponding supply metering orifice.

13. The hydraulic control assembly according to claim 1, further comprising a respective individual pressure compensator connected to an outlet side of each supply metering orifice, each individual pressure compensator including a respective valve spool that has a basic position and that is configured to be shifted from the basic position in a direction of a first switching position and further in the direction to a second switching position, each valve spool further configured to:

close a fluid connection between the corresponding supply metering orifice and the corresponding consumer when in the basic position;

permit a restricted flow of the fluid connection when in the first switching position; and fully open the fluid connection in the second switching position.

14. The hydraulic control assembly according to claim 13, wherein each valve spool is acted upon in a direction of the first and second switching positions by fluid downstream of the corresponding supply metering orifice and in a direction of the basic position by a highest load pressure of the at least two consumers.

15. The hydraulic control assembly according to claim 13, wherein:

the individual pressure compensators are each connected to a common load-sensing line;

each valve spool is configured to:

provide a restricted connection between the load-sensing line and a working line downstream of the corresponding supply metering orifice when in the second switching position; and close the restricted connection when in the first switching position and the basic position; and each valve spool is acted upon in the direction of the basic position by a highest load pressure of the at least two consumers via the load-sensing line.

* * * * *